United States Patent [19]

Bishop

[11] Patent Number: 4,606,992

[45] Date of Patent: Aug. 19, 1986

[54] REFLECTING LAYER FOR IMAGE TRANSFER PRINTS

[75] Inventor: John F. Bishop, Rochester, N.Y.

[73] Assignee: Eastman Kodak Company, Rochester, N.Y.

[21] Appl. No.: 788,292

[22] Filed: Oct. 17, 1985

[51] Int. Cl.[4] ..... G03C 1/40; G03C 5/54

[52] U.S. Cl. ..... 430/220; 430/212

[58] Field of Search ..... 430/212, 220

[56] References Cited

U.S. PATENT DOCUMENTS

| | | | |
|---|---|---|---|
| 3,316,090 | 4/1967 | Rogers | 430/212 |
| 3,351,466 | 11/1967 | Land | 430/229 |
| 3,492,925 | 2/1970 | Ditzer, Jr. et al. | 430/220 |
| 3,585,149 | 12/1970 | Vassiliades et al. | 252/316 |
| 3,620,724 | 11/1971 | Land | 430/220 |
| 3,701,663 | 10/1972 | Kondo et al. | 430/496 |
| 3,833,369 | 9/1974 | Chiklis et al. | 430/220 |
| 4,040,830 | 8/1977 | Rogers | 430/220 |
| 4,133,688 | 1/1979 | Sack | 430/536 |
| 4,239,646 | 12/1980 | Vincent et al. | 252/316 |
| 4,459,346 | 7/1984 | Bishop et al. | 430/212 |

FOREIGN PATENT DOCUMENTS

| | | |
|---|---|---|
| 2416812 | 10/1975 | Fed. Rep. of Germany . |
| 1769412 | 7/1977 | Fed. Rep. of Germany . |

OTHER PUBLICATIONS

Research Disclosure, Item 21910, Jul. 1982, pp. 252–253.

*Primary Examiner*—Richard L. Schilling
*Attorney, Agent, or Firm*—Harold E. Cole

[57] ABSTRACT

Photographic assemblages are described wherein a stripping layer is employed to enable an image-receiving layer to be separated from the rest of the assemblage after processing. A reflecting layer is employed between the image-receiving layer and a transparent support. During processing, the wet reflecting layer is sufficiently transparent to permit transmission viewing of the image through the transparent support. After stripping, the reflecting layer dries to provide a reflective surface for viewing the image from the opposite direction.

20 Claims, No Drawings

REFLECTING LAYER FOR IMAGE TRANSFER PRINTS

This invention relates to photography, and more particularly to color diffusion transfer photography wherein an image-receiving layer has a reflecting layer underneath it to permit transmission viewing of the image through the support during processing while the reflecting layer is wet, and reflection viewing of the image from the opposite direction after processing and stripping when the reflecting layer is dry.

U.S. Pat. No. 4,459,346 issued July 10, 1984, relates to diffusion transfer film assemblages wherein a stripping agent is employed to enable an image-receiving layer on a support to be separated from the rest of the assemblage after processing. A less bulky print can thereby be obtained from an integral assemblage which more closely resembles a conventional print.

A problem with the above prints is that the dyes have to diffuse through a relatively thick reflecting layer before reaching the dye image-receiving layer. This causes a loss in image sharpness. In addition, tne final dye image is viewed through the plastic support. This causes a reduction in D-max and tends to desaturate colors.

It would be desirable to find a way to (1) increase image sharpness by not having the dyes diffuse through a relatively thick reflecting layer, and (2) eliminate the necessity of viewing the final image through a plastic support in order to increase D-max and color saturation. This would enable prints to be obtained which more closely resemble conventional prints.

U.S. Pat. No. 3,585,149 relates to a process for obtaining air-containing microcapsules coated onto or in a support in order to increase opacity. There is no disclosure in this patent, however, that such materials could be used in diffusion transfer assemblages.

U.S. Pat. No. 4,133,688 relates to the use of hollow microspheres in a support of a photographic element. However, there is no disclosure in this patent of the use of such materials in a reflecting layer for color diffusion transfer elements.

In accordance with the invention, a photographic assemblage is provided which comprises:

(a) a photosensitive element comprising a transparent support having thereon the following layers in sequence: a dye image-receiving layer; a stripping layer which enables the support and the dye image-receiving layer to be separated, after processing, from the rest of the assemblage; an alkaline solution-permeable, opaque layer; and at least one silver halide emulsion layer having a dye image-providing material associated therewith;

(b) a transparent cover sheet superposed over the layer outermost from the support of the photosensitive element; and (c) a rupturable container containing an alkaline processing composition and an opacifying agent, the container being so positioned during processing of the assemblage that a compressive force applied to the container will effect a discharge of the container's contents between the transparent cover sheet and the photosensitive element; and wherein a reflecting layer is located between the support and the dye image-receiving layer.

During processing of the assemblage, the reflecting layer becomes wet with processing composition and is sufficiently transparent so that the image which is forming in the integral unit can be viewed through this layer and the transparent support. After a sufficient amount of time has passed, for example 10 minutes or more, the image-receiving layer and reflecting layer are then stripped away from the rest of the assemblage. The image is then viewed from the opposite direction on the reflecting layer background which dries to provide a reflective surface.

Since the image dyes do not have to diffuse through a thick opaque reflecting layer before reaching the dye image-receiving layer, the resultant image is sharper. In addition, the final dye image does not have to be viewed through a thick transparent support so that Dmax is higher and colors are more saturated. The final print also resembles a conventional print since the extraneous layers, spent pod and trap have been stripped away and discarded.

Although the dry image in the "pre-viewing" stage can be seen on the opaque layer background, an auxiliary reflecting layer of a white pigment, such as titanium dioxide, can also be employed between the stripping layer and the silver halide emulsion layer as an aid to improve viewing. This layer can be relatively thin, however, since it is not the reflecting layer for final viewing of the image.

Any reflecting material may be employed in the reflecting layer of the invention as long as it has the necessary reflective properties. There may be employed, for example, light-reflecting pigments such as titanium dioxide, barium sulfate, zinc oxide, barium stearate, silicates, alumina, zirconium oxide, kaolin, mica, etc.; solid polymeric beads or hollow polymeric beads.

In a preferred embodiment of the invention, hollow polymeric beads are employed in the reflecting layer which function to increase the opacity of that layer by scattering back substantial amounts of incident light which would otherwise be transmitted through the support. In another preferred embodiment, these hollow beads have an index of refraction of about 1.3 to about 1.7. This enables the reflecting layer to have an index of refraction approximate to that of the processing composition.

Any hollow polymeric beads may be employed in this preferred embodiment of the invention as long as they will perform the desired function. A particularly good material is manufactured by Rohm and Haas Company, sold under the trademark Ropaque OP-84 ®. This material is described as being hollow spheres of an aqueous acrylic copolymer emulsion with an outside diameter of approximately 0.5–0.6 $\mu$m and an inner void-diameter of approximately 0.3 $\mu$m. As supplied, the beads appear as a milky white liquid, are approximately 40% solids by weight, and have a pH of 9–10. In order to increase the opacity of this layer, a small amount of titanium dioxide may also be added to it.

In another preferred embodiment of the invention, the reflecting layer has at least a minimum void volume of 0.05 cc of air per square foot of element. For example, when using the Ropaque OP-84 ® beads described about at 500 mg/ft$^2$ and 100 mg/ft$^2$ of gelatin, the void volume is 0.15 cc air/ft$^2$ of element.

The hollow polymeric beads employed in the reflecting layer of the preferred embodiment of the invention may be employed in any amount which is effective for the intended purpose. In general, good results have been obtained at a concentration of from about 150 to about 1500 mg/ft$^2$ of element. The amount of other reflecting materials useful in the invention can easily be determined by one skilled in the art.

Any material may be employed as the stripping layer in the invention provided it has the required properties. Such materials are disclosed, for example, in U.S. Pat. Nos. 3,220,835, 3,730,718 and 3,820,999 and include gum arabic, sodium alginate, pectin, polyvinyl alcohol and hydroxyethyl cellulose. In a preferred embodiment of this invention, hydroxyethyl cellulose is employed.

The stripping layer materials employed in this invention can be employed in any amount which is effective for the intended purpose. In general, good results have been obtained at a concentration of from about 5 to about 2000 mg/m$^2$ of element. The particular amount to be employed will vary, of course, depending on the particular stripping layer material employed and the particular diffusion transfer element selected.

A hydrophilic layer may be employed on each side of the stripping layer in this invention as disclosed in U.S. Pat. No. 4,529,683. A particulate material, such as carbon black, may also be employed in one of the hydrophilic layers to further enhance the reliability of clean separation of the image-receiving layer from the remainder of the assemblage, as disclosed in U.S. Pat. No. 4,499,174.

In general, the processing composition employed in this invention contains the developing agent for development, although the composition could also just be an alkaline solution where the developer is incorporated in the photographic element or cover sheet, in which case the alkaline solution serves to activate the incorporated developer.

The dye image-providing material useful in this invention is either positive- or negative-working, and is either initially mobile or immobile in the photographic element during processing with an alkaline composition. Examples of initially mobile, positive-working dye image-providing materials useful in this invention are described in U.S. Pat. Nos. 2,983,606; 3,536,739; 3,705,184; 3,482,972; 2,756,142; 3,880,658 and 3,854,985. Examples of negative-working dye image-providing materials useful in this invention include conventional couplers which react with oxidized aromatic primary amino color developing agents to produce or release a dye such as those described, for example, in U.S. Pat. No. 3,227,550 and Canadian Pat. No. 602,607. In a preferred embodiment of this invention, the dye image-providing material is a ballasted, redox dye-releasing (RDR) compound. Such compounds are well known to those skilled in the art and are, generally speaking, compounds which will react with oxidized or unoxidized developing agent or electron transfer agent to release a dye. Such nondiffusible RDR's include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; 4,149,892 of Deguchi et al; 4,198,235 and 4,179,291 of Vetter et al; *Research Disclosure* 15157, November, 1976 and *Research Disclosure* 15654, April, 1977. Such nondiffusible RDR's also include positive-working compounds, as described in U.S. Pat. Nos. 3,980,479; 4,139,379; 4,139,389; 4,199,354, 4,232,107, 4,199,355 and German Pat. No. 2,854,946, the disclosures of which are hereby incorporated by reference.

In a preferred embodiment of the invention, RDR's such as those in the Fleckenstein et al patent referred to above are employed. Such compounds are ballasted sulfonamido compounds which are alkali-cleavable upon oxidation to release a diffusible dye from the nucleus and have the formula:

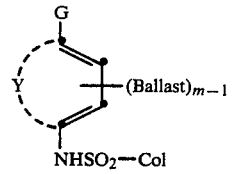

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is OR or NHR$^1$ wherein R is hydrogen or a hydrolyzable moiety and R$^1$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when R$^1$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) m is a positive integer or 1 to 2 and is 2 when G is OR or when R$^1$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529.

In another preferred embodiment of the invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

A format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer, the stripping layer and adjacent hydrophilic layers described above, and the photosensitive layer or layers described above. A rupturable container, containing an alkaline processing composition including a developing agent and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

The film unit or assemblage of the present invention is used to produce positive images in single or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith and the red-sensitive silver halide emulsion layer will have a cyan dye image-providing material associated therewith. The dye image-providing material associated with each silver halide emulsion layer is contained either in the silver halide emulsion layer itself or in a layer contiguous to the silver halide emulsion layer, i.e., the dye image-providing material can be coated in a separate layer underneath the silver halide emulsion layer with respect to the exposure direction.

The concentration of the dye image-providing material that is employed in the present invention can be varied over a wide range, depending upon the particular compound employed and the results desired. For example, the dye image-providing material coated in a layer at a concentration of 0.1 to 3 $g/m^2$ has been found to be useful. The dye image-providing material is usually dispersed in a hydrophilic film forming natural material or synthetic polymer, such as gelatin, polyvinyl alcohol, etc., which is adapted to be permeated by aqueous alkaline processing composition.

A variety of silver halide developing agents are useful in this invention. Specific examples of developers or electron transfer agents (ETA's) useful in this invention include hydroquinone compounds, catechol compounds, and 3-pyrazolidinone compounds as disclosed in column 16 of U.S. Pat. No. 4,358,527, issued Nov. 9, 1982. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the dye image-providing material layers, interlayers, image-receiving layer, etc.

In this invention, in which dye image-providing materials can be used which produce diffusible dye images as a function of development, either conventional negative-working or direct-positive silver halide emulsions can be employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted dye image-providing materials. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye image-providing material compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Reasearch Disclosure,* the disclosure of which is hereby incorporated by reference.

Any material is useful as the dye image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Reasearch Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Reasearch Disclosure,* and pages 35 through 37 of the July 1975 edition of *Reasearch Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g, alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Reasearch Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Reasearch Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

In using the assemblage of the invention, the image is laterally reversed, right to left. An image-reversing optical system, such as a mirror, can be employed in the camera to make the image "right-reading."

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Pat. No. 4,362,806, issued Dec. 7, 1982.

The silver halide emulsions useful in this invention, both negative-working and direct-positive ones, are well known to those skilled in the art and are described in *Research Disclosure,* Volume 176, Dec. 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following example is provided to further illustrate the invention.

EXAMPLE

A photosensitive (donor) element was prepared similar to that described in Example 1 of U.S. Pat. No. 4,436,160. It contained negative-working silver halide emulsion layers and cyan, magenta and yellow redox dye-releasers, all of which are conventional image transfer materials. (Note: This was used merely as a convenient means of supplying dye to the receiver for evaluation purposes.)

(A) A receiving element was prepared by coating the following layers on a transparent poly(ethylene terephthalate) film support. Quantities are parenthetically given in grams per square meter.

(1) Reflecting layer of titanium dioxide (2.2) and gelatin (0.22*);

(2) Receiving layer of poly(styrene-co-N-benzyl-N,N-dimethyl-N-vinylbenzylammonium chloride-co-divinyl-benzene) (98:98:2 weight ratio) (2.3) and gelatin (2.3);

(3) Stripping layer of Natrosol® hydroxyethyl cellulose (0.43);

(4) Auxiliary reflecting layer of titanium dioxide (8.5) and gelatin (1.3); and (5) Opaque layer of carbon (1.3) and gelatin (0.8).

*The gelatin level was reduced in this layer in order to improve the transmission (wet) density. (As the gelatin is increased, lower D-max values are obtained.)

(B) An element was prepared similar to (A) except that the reflecting layer (1) was solid beads of poly(-methyl methacrylate), 0.55 μ diameter (2.2) and gelatin (0.43).

(C) An element was prepared similar to (A) except that the reflecting layer (1) was Ropaque OP-84® hollow beads (Rohm and Haas Co.) (2.2) and gelatin (0.43).

Alkaline processing pods of the following composition were prepared:

| | |
|---|---|
| Potassium hydroxide | 45.0 g/l |
| 5-Methylbenzotriazole | 3.0 g/l |
| Potassium bromide | 2.0 g/l |
| Carboxymethyl cellulose | 42.0 g/l |

An exposed donor element, with graduated-density red, green and blue D-min to D-max exposure, was laminated to the receivers by spreading the contents of the alkaline processing pod using a pair of 100 μm gap juxtaposed rollers. After not less than 10 minutes, the red, green, and blue Status A reflection densities of the receivers were read through the support from reflecting layer side of the laminated unit. These "wet" reflection densities represent viewing conditions that would be experienced during development and dye transfer of an image transfer element.

The opaque and auxiliary reflecting layers 4 and 5 were next separated and discarded. The remainder of the structure comprising the receiving and reflecting layer on the transparent support was allowed to dry for approximately ten minutes and was then read to Status A reflection density from the receiver side. This would represent "dry" densities of the final image as would be seen after all development and dry transfer had occurred. The following results were obtained:

| Receiver | Reflecting Layer | | Reflection Density (D-max/D-min) Through Support Integral (Wet) | Receiver Side Peeled (Dry) |
|---|---|---|---|---|
| A | Titanium dioxide | R | 0.8/0.2 | 2.1/0.4 |
| | | G | 0.6/0.2 | 2.1/0.4 |
| | | B | 0.5/0.2 | 2.0/0.4 |
| B | Solid poly(methyl-methacrylate) beads | R | 2.1/0.3 | 2.3/1.2 |
| | | G | 2.2/0.3 | 2.2/1.1 |
| | | B | 2.2/0.3 | 2.2/1.0 |
| C | Ropaque OP-84® hollow beads | R | 0.9/0.2 | 2.1/0.4 |
| | | G | 0.8/0.2 | 2.1/0.4 |
| | | B | 0.8/0.2 | 2.0/0.4 |

The results indicate that all receivers had sufficient image discrimination for both transmission viewing (wet) and reflection viewing when dry.

The invention has been described in detail with particular reference to preferred embodiments thereof, but it will be understood that variations and modifications can be effected within the spirit and scope of the invention.

What is claimed is:

1. In a photographic assemblage comprising:

(a) a photosensitive element comprising a transparent support having thereon the following layers in sequence: a dye image-receiving layer; a stripping layer which enables said support and said dye image-receiving layer to be separated, after processing, from the rest of said assemblage; an alkaline solution-permeable, opaque layer; and at least one silver halide emulsion layer having a dye image-providing material associated therewith;

(b) a transparent cover sheet superposed over the layer outermost from the support of said photo-sensitive element; and (c) a rupturable container containing an alkaline processing composition and an opacifying agent, said container being so positioned during processing of said assemblage that a compressive force applied to said container will effect a discharge of the container's contents between said transparent cover sheet and said photosensitive element;

the improvement wherein a reflecting layer is located between said transparent support and said dye image-receiving layer.

2. The assemblage of claim 1 wherein said reflecting layer comprises hollow polymeric beads.

3. The assemblage of claim 1 wherein said reflecting layer comprises titanium dioxide.

4. The assemblage of claim 1 which contains an auxiliary reflecting layer between said stripping layer and said silver halide emulsion layer.

5. The assemblage of claim 2 wherein said beads have an index of refraction of about 1.3 to about 1.7.

6. The assemblage of claim 2 wherein said reflecting layer has at least a minimum void volume of 0.05 cc of air per square foot of element.

7. The assemblage of claim 2 wherein said reflecting layer also contains titanium dioxide.

8. The assemblage of claim 2 wherein said beads in said reflecting layer have an index of refraction approximate to that of said processing composition so that said layer becomes transparent when wet with said processing composition, and translucent when subsequently dried.

9. The assemblage of claim 2 wherein said beads comprise an aqueous acrylic copolymer emulsion with an outside diameter of approximately 0.5–0.6 μm and an inner void-diameter of approximately 0.3 μm.

10. The assemblage of claim 1 wherein said photosensitive element comprises a support having thereon a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith.

11. The assemblage of claim 1 wherein said transparent cover sheet is coated with, in sequence, a neutralizing layer and a timing layer.

12. In an integral photographic assemblage comprising:

(a) a photosensitive element comprising a transparent support having thereon the following layers in sequence: a dye image-receiving layer; a stripping layer which enables said dye image-receiving layer to be separated, after processing, from the rest of said assemblage; an alkaline solution-permeable, light-reflective layer; an alkaline solution-permeable, opaque layer; a red-sensitive silver halide emulsion layer having a cyan dye image-providing material associated therewith; a green-sensitive silver halide emulsion layer having a magenta dye image-providing material associated therewith; and a blue-sensitive, silver halide emulsion layer having a yellow dye image-providing material associated therewith;

(b) a transparent cover sheet superposed over said blue-sensitive silver halide emulsion layer; and (c) a rupturable container containing an alkaline processing composition and an opacifying agent, said container being so positioned during processing of said assemblage that a compressive force applied to said container will effect a discharge of the container's contents between said transparent cover sheet and said blue-sensitive silver halide emulsion layer;

the improvement wherein a reflecting layer is located between said transparent support and said dye image-receiving layer.

13. The assemblage of claim 12 wherein said reflecting layer comprises hollow polymeric beads.

14. The assemblage of claim 12 wherein said reflecting layer comprises titanium dioxide.

15. The assemblage of claim 13 wherein said beads have an index of refraction of about 1.3 to about 1.7.

16. The assemblage of claim 13 wherein said reflecting layer has at least a minimum void volume of 0.05 cc of air per square foot of element.

17. The assemblage of claim 13 wherein said reflecting layer also contains titanium dioxide.

18. The assemblage of claim 13 wherein said beads in said reflecting layer have an index of refraction approximate to that of said processing composition so that said layer becomes transparent when wet with said processing composition, and translucent when subsequently dried.

19. The assemblage of claim 13 wherein said beads comprise an aqueous acrylic copolymer emulsion with an outside diameter of approximately 0.5–0.6 μm and an inner void-diameter of approximately 0.3 μm.

20. The assemblage of claim 12 wherein said transparent cover sheet is coated with, in sequence, a neutalizing layer and a timing layer.

* * * * *